US011033067B2

(12) United States Patent
Krumbeck et al.

(10) Patent No.: US 11,033,067 B2
(45) Date of Patent: Jun. 15, 2021

(54) BEARING STRUCTURE WITH A PRONOUNCED UPWARD ARCH

(71) Applicant: MARKER Deutschland GmbH, Penzberg (DE)

(72) Inventors: Markus Krumbeck, Farchant (DE); Michael Mangold, Grainau (DE)

(73) Assignee: MARKER Deutschland GmbH, Penzberg (DE)

( * ) Notice: Subject to any disclaimer, the term of this patent is extended or adjusted under 35 U.S.C. 154(b) by 592 days.

(21) Appl. No.: 15/184,404

(22) Filed: Jun. 16, 2016

(65) Prior Publication Data

US 2017/0196298 A1 Jul. 13, 2017

(30) Foreign Application Priority Data

Jan. 13, 2016 (EP) ..... 16151150

(51) Int. Cl.
*A43B 5/04* (2006.01)
*A63C 9/00* (2012.01)
(Continued)

(52) U.S. Cl.
CPC ..... *A43B 5/04* (2013.01); *A63C 9/001* (2013.01); *A63C 9/005* (2013.01); *A63C 9/0807* (2013.01);
(Continued)

(58) Field of Classification Search
CPC ..... A43B 5/04; A43B 5/0401; A43B 5/0403; A43B 5/0417; A63C 10/20; A63C 10/28
(Continued)

(56) References Cited

U.S. PATENT DOCUMENTS 4,392,666 A * 7/1983 Ramer ..... A43B 5/0417 280/614
4,505,056 A * 3/1985 Beneteau ..... A43B 13/141 36/117.2
(Continued)

FOREIGN PATENT DOCUMENTS

| | | | |
|---|---|---|---|
| DE | 20200272 | U1 | 5/2002 |
| EP | 2786789 | A1 | 10/2014 |
| FR | 2583296 | A1 | 12/1986 |

OTHER PUBLICATIONS

EPO Extended European Search Report for European application No. 16151150.6, dated May 6, 2016, 7 pages.

*Primary Examiner* — Timothy K Trieu
(74) *Attorney, Agent, or Firm* — Luedeka Neely Group, P.C.

(57) ABSTRACT

The invention relates to a combination of a downhill binding or downhill ski binding, in particular a front jaw of the downhill binding, and a ski boot. The ski boot (10) comprises a rigid ski boot shell (11) and a sole (1) of the ski boot comprising a front end (1*b*) of the sole, a rear end of the sole, an upper side (1*a*) of the sole and a lower side (1*c*) of the sole. The downhill binding comprises a front jaw (20) and a rear jaw, wherein the downhill binding comprises a bearing structure (2) for the sole (1) of the ski boot. The bearing structure (2) has an apex (5) which has a distance (X1), in the longitudinal direction (X), from the front end (1b) of the sole held in the downhill binding of at least 28 mm and at most 34 mm, and wherein the apex (5) exhibits a perpendicular distance (Y2) from the upper side (1*a*) of the sole of the ski boot held in the downhill binding of 19 mm±2 mm in at least one point.

20 Claims, 3 Drawing Sheets

Figure 1:
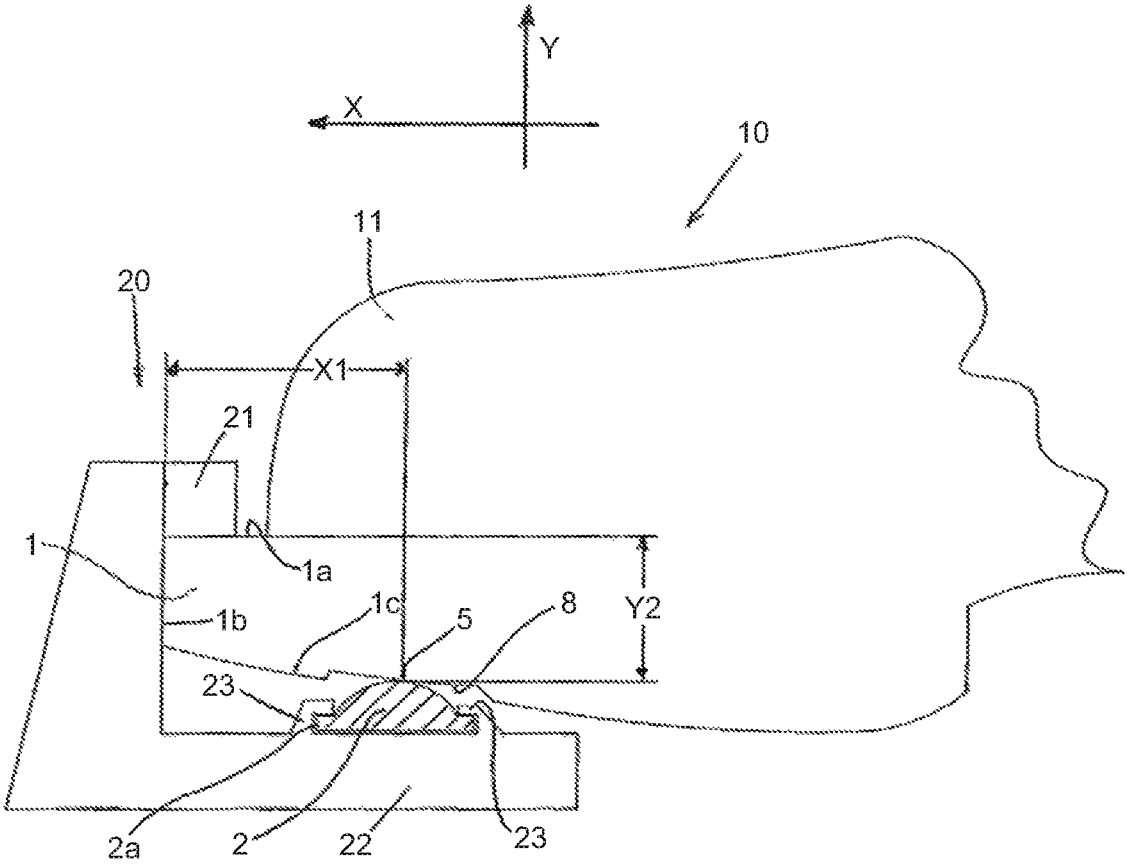

(51) Int. Cl.
*A63C 9/08* (2012.01)
*A63C 9/085* (2012.01)
*A63C 9/22* (2012.01)
*A63C 9/10* (2012.01)

(52) U.S. Cl.
CPC ..... *A63C 9/08592* (2013.01); *A63C 9/10* (2013.01); *A63C 9/22* (2013.01)

(58) Field of Classification Search
USPC ..... 36/115, 116, 117.8, 122, 125
See application file for complete search history.

(56) References Cited

U.S. PATENT DOCUMENTS 5,088,756 A * 2/1992 Hue ..... A63C 9/20 280/607
5,659,981 A * 8/1997 Liautaud ..... A63C 13/001 36/122
5,809,668 A * 9/1998 Kiniry ..... A63C 13/001 36/122
5,845,421 A * 12/1998 Tanaka ..... A43B 5/0401 36/117.3
6,202,326 B1 * 3/2001 Hauglin ..... A43B 5/0415 36/117.2
6,247,252 B1 * 6/2001 Parisotto ..... A43B 5/04 36/118.7
6,409,204 B1 * 6/2002 Ayliffe ..... A43B 5/0494 280/613
6,523,851 B1 * 2/2003 Maravetz ..... A63C 5/02 280/14.22
7,810,257 B2 * 10/2010 Candrian ..... A43B 1/0027 36/100
9,161,589 B2 * 10/2015 Parisotto ..... A43B 5/0494
10,455,889 B2 * 10/2019 Krumbeck ..... A43B 5/0496
2002/0093176 A1 * 7/2002 Thomas ..... A63C 9/00 280/625
2004/0148808 A1 * 8/2004 Okajima ..... A43B 5/0421 36/117.3
2008/0272577 A1 * 11/2008 Kogler ..... A63C 9/20 280/615
2009/0255149 A1 * 10/2009 Rigat ..... A43B 1/0018 36/117.3
2010/0313448 A1 * 12/2010 Girard ..... A43B 5/0413 36/117.3
2011/0271557 A1 * 11/2011 Barthel ..... A43B 5/0423 36/117.1
2012/0042542 A1 * 2/2012 Lehner ..... A43B 5/0417 36/117.1
2014/0300068 A1 * 10/2014 Rullier ..... A63C 9/22 280/11.33
2014/0361514 A1 * 12/2014 Allmann ..... A43B 5/047 280/613

* cited by examiner

BEARING STRUCTURE WITH A PRONOUNCED UPWARD ARCH

This application claims the benefit of the earlier filing date of European patent application 16 151 150.6, filed Jan. 13, 2016.

The invention relates to a combination of a downhill or Alpine ski binding, in particular a front jaw of the downhill ski binding, and a ski boot. The ski boot comprises a rigid ski boot shell and a sole of the ski boot comprising a front end of the sole, a rear end of the sole, an upper side of the sole and a lower side of the sole. The downhill ski binding comprises a front jaw and a rear jaw and a bearing structure or bearing plate for the sole of the ski boot, wherein the bearing structure has an apex which has a distance, in the longitudinal direction, from the front end of the sole held in the downhill ski binding of at least 28 mm, and wherein the apex exhibits a perpendicular distance from the upper side of the sole of 19 mm±2 mm in at least one point. The invention also relates to a front jaw comprising the bearing structure and to the bearing structure itself.

A downhill ski binding comprising a front retaining element for an Alpine ski boot or downhill ski boot is known from DE 202 00 272 U1. The front retaining element comprises a base plate, a housing, at least one sole retainer and a support device on which the sole of the ski boot held in the front retaining element stands upright. The support device comprises a substantially planar supporting surface and has a cruciform shape as viewed from above. DE 202 00 272 U1 proposes several ways of setting the sole retainers or the supporting surface, using which a vertical distance between the supporting surface and the sole retainers can be adapted to ski boots comprising soles of varying thickness.

It is an object of the invention to provide a front jaw for a downhill ski binding which enables secure downhill skiing using a touring ski boot, which is preferably designed specially, without having to adjust the height of the front jaw or a part of the front jaw, such as the sole retainer or the supporting surface, for this purpose.

This object is solved by the combination in accordance with claim 1, the subject-matter in accordance with claim 7 and the subject-matter in accordance with claim 13.

The dependent claims relate to features which, individually or in combination, are suitable for advantageously developing the subject-matter of the independent claims, wherein features of the dependent claims can develop any subject-matter of an independent claim, where expedient, irrespective of the independent claim to which they are directly assigned and irrespective of the category of the independent claims.

One aspect of the invention relates to a combination of a downhill or Alpine ski binding and a ski boot. In particular, the invention relates to a combination of a front jaw of the downhill ski binding and the ski boot.

The ski boot comprises a preferably rigid ski boot shell and a sole of the ski boot comprising a front end of the sole, a rear end of the sole, an upper side of the sole and a lower side of the sole. The ski boot can be a touring ski boot which is designed such that it can be used with the downhill ski binding described below. It can for example be a ski boot comprising a front attaching region which is formed such that it meets the requirements of DIN ISO 5355 for downhill ski boots, and DIN ISO 9523 for touring ski boots, as current on the date of application. An application for such a suitable ski boot has been filed in parallel with this application.

The downhill binding comprises a front jaw, a rear jaw and a bearing structure, wherein the bearing structure has an apex which has a distance, in the longitudinal direction, from the front end of the sole of a ski boot held in the downhill ski binding of at least 28 mm and at most 34 mm, preferably 31 mm±3 mm, particularly preferably 32 mm±2 mm, and wherein the apex of the bearing structure has a perpendicular distance from the upper side of the sole of the ski boot, which is secured in the front jaw and stands on the apex, of 19 mm±2 mm in at least one point.

The term "apex" is also to be understood to mean a line of numerous adjoining points which together form an apical line or a two-dimensional area which is formed from numerous points and thus forms an apical area, i.e. the choice of words shall not limit the invention to a punctiform apex, such as for example the point of contact between a line and a sphere, but rather the apex can also be a linear apex, for example the line of contact between an area and the circumferential surface of a circular cylinder, or a two-dimensional apex, for example the area of contact between an area and a truncated cone.

The distance between the apex and the front end of the ski boot held in the downhill ski binding can in particular be 32 mm±1 mm, and the vertical or perpendicular distance between the upper side of the sole of the ski boot and the apex of the bearing structure can in particular be 19 mm±1 mm or preferably 19 mm±0.3 mm. In keeping with the specifications of the two standards mentioned, the vertical distance between the upper side of the sole of the ski boot and the apex of the bearing structure can have any value between 17 mm and 21 mm, and the horizontal distance between the apex of the bearing structure and the front end of the sole can be between about 28 mm and 34 mm.

A front attaching region of the ski boot comprises a specially prepared portion which includes the point, line or area of contact via which the ski boot lies on the apex of the bearing structure when the ski boot is held in the front jaw. This prepared portion can be a recess and/or a portion of the lower side of the sole which exhibits special properties such as hardness, conduciveness to sliding, etc. The portion starts from the front end of the sole of the ski boot, as viewed at a distance in the longitudinal direction which is preferably smaller than the distance between the apex of the bearing structure and the front end of the sole.

In a region which is behind the apex in the skiing direction, an upper side of the bearing structure and the lower side of the sole can together form a free space in which the sole of the ski boot is not in contact with the bearing structure. The free space can in particular be recognisable as a two-dimensional free space when viewing a vertical section along the longitudinal centreline of the ski boot, which means that the shape of the sole of the ski boot behind the apex in the skiing direction preferably does not follow the shape of the bearing structure in this region, and vice versa. The free space can in particular be limited towards the front and/or top by the bearing structure and a lower side of a planar sole of the ski boot according to DIN ISO 5355 and can exhibit a height, measured perpendicular to the surface of the ski, of at least 5 mm at a distance from the apex of about 20 mm or at a distance from the front end of the sole of about 52 mm.

Another aspect of the invention relates to a front jaw of a downhill ski binding. The front jaw can in particular comprise a base structure, which is or can be connected to a ski, and a housing which is or can be connected to the base structure. The front jaw also comprises at least one sole retainer which is connected, such that it can pivot, to the housing. A pivot axis which connects the sole retainer to the housing can point substantially perpendicular to the surface of the ski. The sole retainer can be tensed towards the sole of the ski boot by means of a spring force and can press the sole of the ski boot onto the ski. Instead of sole retainers, the front jaw can also comprise pins which co-operate with corresponding pin receptacles on a ski boot, in order to secure the ski boot in the front jaw during travel.

The front jaw also comprises a bearing structure for the sole of the ski boot. The bearing structure is or can be connected to the base structure of the front jaw or to the ski. The bearing structure can be fixed relative to the base structure, such that it cannot move relative to the base structure, or the bearing structure can be able to move relative to the base structure, for example linearly or in an arc. The movement direction can in particular be aligned substantially transverse to a skiing direction, such that when the ski binding is released transversely, the bearing structure can move together with the ski boot transverse to the skiing direction.

The bearing structure has a shape comprising an apex, an apical line or an apical area. The apex, apical line or apical area forms a bearing interface for the sole of the ski boot.

The bearing structure can in particular have a concave shape, preferably an arched and in particular significantly arched shape, such as for example a semi-circular, semi-lenticular, circular-segmental, triangular or similar shape, wherein the apex forms the point, line or area of the bearing structure which has a maximum distance between the bearing structure and the base structure or surface of the ski, as measured orthogonally with respect to the surface of the ski.

As viewed from above, a projection area of the bearing structure can exhibit any shape, for example an oval, round, circular, lenticular, quadrilateral or polygonal shape.

The apex or bearing interface can be embodied centrically or eccentrically on the bearing structure in the skiing direction, i.e. the apex can form the middle of the bearing structure as viewed in the skiing direction, wherein the two halves in front of and behind the apex can have the same shape or can exhibit different shapes. Thus, in the case of a significantly arched bearing plate, one half which is a front half in the skiing direction can for example be formed by a segment of a circle or circular segment, while a half which is a rear half in the skiing direction can be a straight line or can exhibit a concave shape.

If the bearing interface lies outside the middle of the bearing structure, the apex can be embodied or arranged in the front region or the rear region of the bearing structure in the skiing direction. In this case, the apex is preferably embodied in the front region of the bearing plate.

The shape of the front region and rear region can then be freely chosen. The significantly arched shape of the bearing structure can for example be formed from a first circular segment having a first radius and a second circular segment having a second radius. In this case, the apex can be formed by the point in which the two circular segments meet, i.e. the bearing structure, which is divided into a front region and rear region of differing lengths in the skiing direction, comprises an arch which is for example formed from a shorter region having the first radius and a longer region having the second radius, wherein the first radius does not correspond to the second radius but is instead larger or smaller.

If the bearing structure is one which is formed from two regions of differing lengths in the skiing direction, wherein the apex of the bearing plate is embodied where the shorter region and the longer region abut against each other, then the shorter region is preferably in front of the longer region in the skiing direction, i.e. in the case of an arch consisting of two circular segments of differing radii, the circular segment having the smaller radius is in front of the second circular segment having the larger radius in the skiing direction.

The bearing structure which is or can be connected, such that it can move, to the front jaw or, respectively, to the base structure for the front jaw or to the ski can comprise guide portions which, together with guide elements formed by the base structure or the ski, form a guide for the bearing structure. As already described further above, the bearing structure can be moved relative to the base structure in a direction transverse to the skiing direction, in order to enable or assist a corresponding movement of the ski boot, for example when the front jaw is released transversely. The guide portions can be formed on the front or rear end of the bearing structure in the skiing direction. At least one of the guide portions can be formed by a base of the bearing structure. If the bearing structure is embodied with the two regions of differing lengths, the guide portion can be formed or integrated in the part of the base of the longer of the two regions.

Another aspect relates to a bearing structure for the sole of a ski boot, which can be connected to a front jaw or a base structure of a front jaw of a ski binding or to the ski binding or to the ski. The ski binding can in particular be a downhill or Alpine ski binding. The bearing structure comprises a bearing interface which supports the sole of the ski boot when the ski boot is held on the ski by the toe retainer. The bearing interface can for example be formed to be punctiform or linear or can form a bearing area for the sole of the ski boot.

The bearing structure can be a body made of a single material, such as for example a metal or a plastic. The metal can in particular be a light metal, such as aluminium, or a stainless steel; the plastic can in particular be a hard plastic which exhibits metal-like material properties in relation to for example its elasticity, resistance to cold, abrasion, conduciveness to sliding, etc. The body can be entirely or partially a solid-material body and/or a hollow body.

The bearing structure can comprise multiple materials which lie on top of each other in layers and/or surround each other over their whole surface. The outermost layer of the bearing plate in the region and/or vicinity of the bearing area for the ski boot can comprise a structure which prevents or at least hampers the ski boot from being able to move relative to the bearing area when it is clamped in the front jaw.

The bearing structure comprises a bearing point, bearing line or bearing area and a guide region which can help to form the base of the bearing structure or which is embodied in the base of the bearing structure. The guide region comprises at least one guide portion which is embodied such that, together with at least one guide element which is formed on the front jaw or on the base structure of the front jaw or on the ski, it forms a guide for the bearing structure transverse to a skiing direction. This guide can enable or at least facilitate releasing the ski binding transversely.

The bearing structure is the bearing structure described with respect to the first and second aspects, wherein all the features and/or combinations of features which have been described with respect to the aspect of the combination and with respect to the aspect of the front jaw and with respect to the aspect of the bearing structure apply reciprocally to the combination, the toe retainer and the bearing structure.

In the following, an example embodiment of a bearing structure is described in more detail on the basis of figures, without limiting the invention to the example embodiment. Features and combinations of features essential to the invention which are only rendered in the figures form part of the scope of the invention and can advantageously develop the subject-matter of claim 1.

Figure 2:
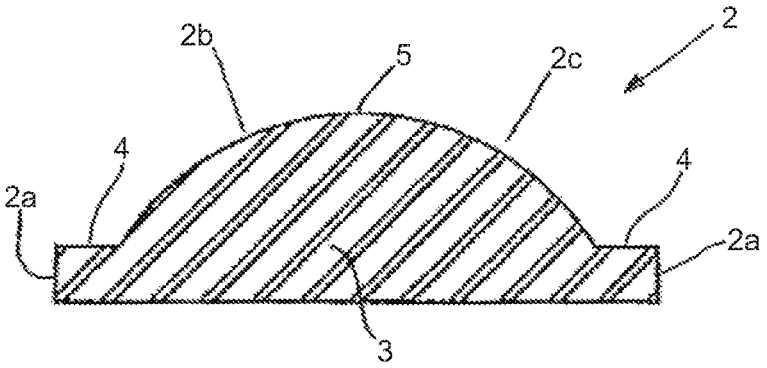
Figure 3:
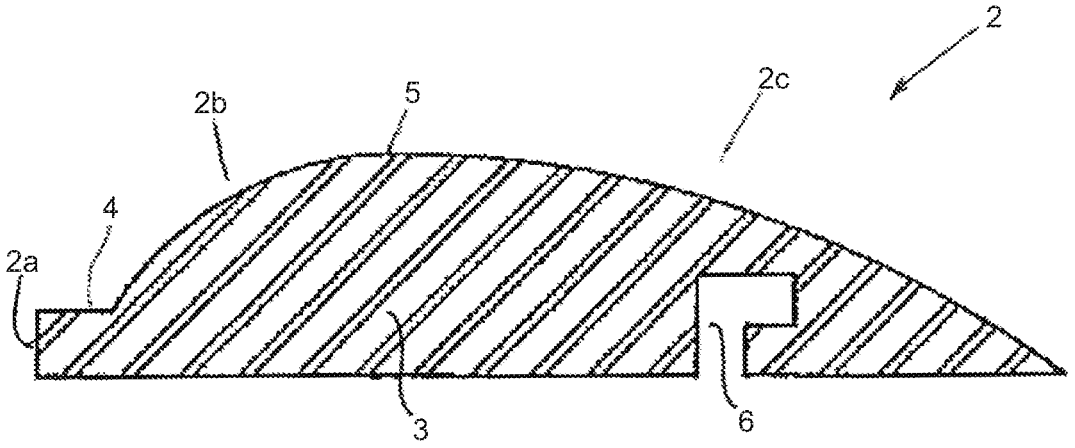
Figure 4:
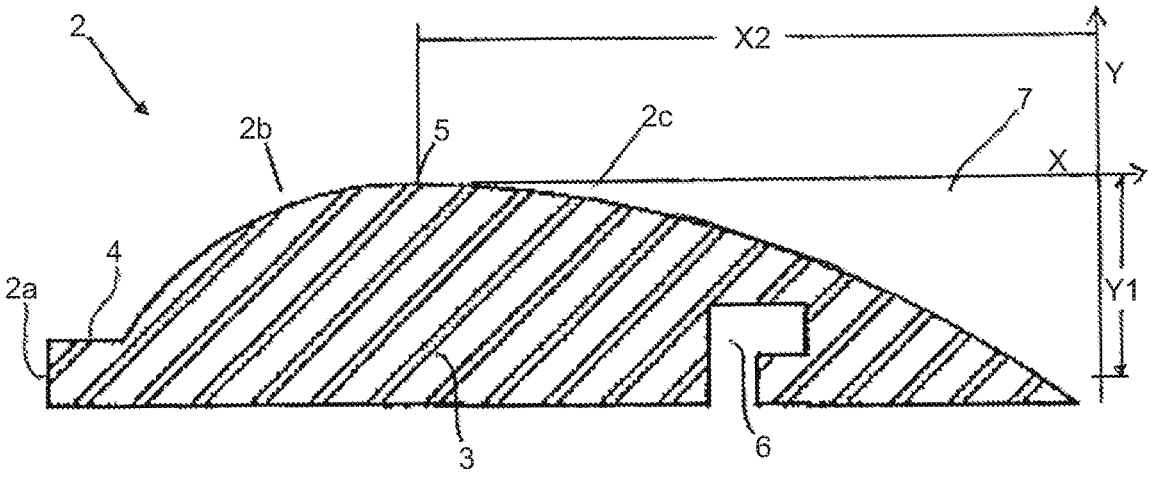
Figure 5:
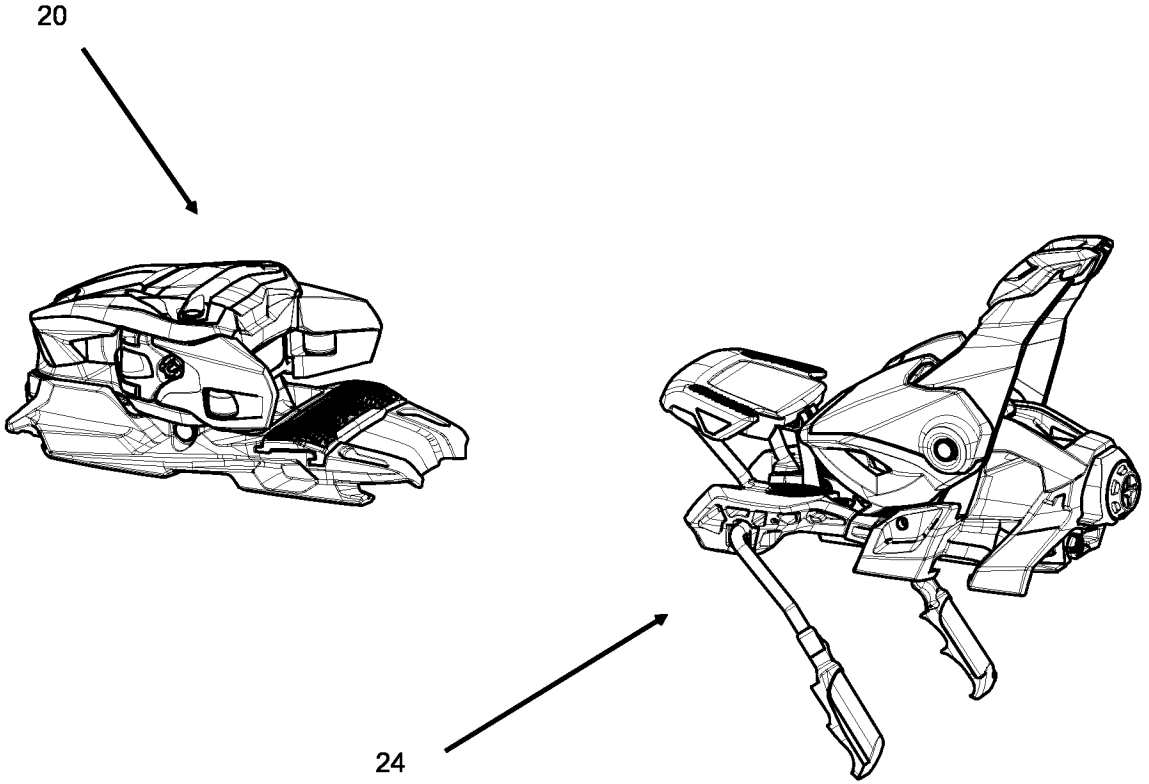

Individually, the figures show:

FIG. 1 a front jaw together with a ski boot and a bearing structure;

FIG. 2 a bearing structure which exhibits a centric bearing interface;

FIG. 3 a bearing structure which exhibits an eccentric bearing interface;

FIG. 4 a free space between the bearing structure and the sole of the ski boot; and FIG. 5 a front jaw and a rear jaw of a ski binding.

FIG. 1 shows a combination of a ski binding, in particular a downhill ski binding, and a ski boot 10. Only the front jaw 20 of the binding and the front attaching region of the ski boot 10 is shown.

The ski boot 10 comprises a preferably rigid ski boot shell 11 and a sole 1 of the ski boot comprising an upper side 1*a*, a front end 1*b* and a lower side 1*c*. The front jaw 20 comprises a sole retainer 21 and a base structure 22. The base structure 22 comprises two guide elements 23.

In the example embodiment shown, the binding or the front jaw 20 comprises a bearing structure 2. The bearing structure 2 has a concavely arched shape featuring a base 3 which comprises a guide portion 4 at each of its two ends transverse to the skiing direction. The bearing structure 2 also comprises a bearing interface which forms an apex 5 of the bearing structure 2. In the example embodiment, the bearing structure 2 is mounted, such that it can move, in the base structure 22 of the front jaw 20.

A front attaching region of the ski boot 10 has a recess 8 in the lower side 1*c* of the sole, wherein the recess 8 encompasses the point, line or area of contact between the ski boot 10 and the apex 5 of the bearing structure 2.

FIG. 2 shows the bearing structure 2 of FIG. 1, separated from the front jaw 20, in a sectional view parallel to an imaginary longitudinal axis of a ski which is connected to the front jaw 20 of FIG. 1. The bearing structure 2 comprises a base 3 via which it can be connected to the base structure 22 of the front jaw 20.

At each of a front and rear end 2a of the bearing structure 2 in the skiing direction, the base 3 comprises a guide portion 4 which, together with the guide elements 23 indicated in FIG. 1, forms a guide joint for the bearing structure 2. In the example embodiment, the arch of the bearing structure 2 is shaped as a circular segment and features an apex 5 of the circular segment which forms a bearing interface for a ski boot 10.

In the example embodiment, the bearing structure 2 is a body made of a solid material. The material can be a metal or a suitable plastic which exhibits the appropriate properties such as elasticity, strength, thermal stability, etc. The bearing structure 2 can alternatively also be embodied as a hollow structure, with or without reinforcing ribs.

FIG. 3 shows another example embodiment of a bearing structure 2 in accordance with the invention. This bearing structure 2 has an arched shape which consists of two regions 2*b*, 2*c* which are arched to differing degrees. Each of the two regions 2*b*, 2*c* is formed from a circular segment. The circular segment of the first region 2*b* exhibits a first radius, and the circular segment of the second region 2*c* exhibits a second radius, wherein in the example embodiment, the second radius is larger than the first radius.

The apex 5 is formed at an outer point or line of contact between the two regions 2*b*, 2*c*, i.e. in a surface point or surface line in which the two regions 2*b*, 2*c* contact each other. In the example embodiment shown, this means that the apex 5 of the arch is formed in a part of the bearing structure 2 which is a front part in the skiing direction.

The base 3 of the bearing structure 2 comprises a guide portion 4 and a guide 6. While the guide portion 4, which is a front guide portion in the skiing direction, forms an end 2*a* of the bearing structure 2 as in the case of the bearing structure 2 of FIG. 2, the guide 6 is incorporated or integrated into the base 3 in the second region 2*c* of the bearing structure 2.

FIG. 4 substantially corresponds to FIG. 3. In this figure, a free space 7 has been additionally indicated which is formed between the apex 5 and an end of the bearing structure 2 which is a rear end in the skiing direction and the lower side 1*c* of the sole of a ski boot 10 held in the front jaw 20. The representation shows that the lower side 1*c* of the sole is not in contact with the bearing structure 2 in the second region 2*c* of the bearing structure 2, but that the ski boot 10 or, respectively, the lower side 1*c* of the sole instead only stands upright on the ski or on the base structure 22 of the front jaw 20 behind the bearing structure 2 in the skiing direction. The shape of the lower side 1*c* of the sole does not follow the shape of the bearing structure 2 behind the apex 5, such that a two-dimensional free space 7 is formed. The free space 7 starts at the apex 5 and has a clear distance Y1 between a lower side of a planar sole 1 of the ski boot according to DIN ISO 5355 and a surface of the bearing structure 2 which points away from the ski or the corresponding surface of the base 3 of the bearing structure 2 or an upper side of the ski of at least 5 mm at a distance X1 of about 20 mm behind the apex 5 in the skiing direction. This ensures that the lower side 1*c* of the sole rests on the bearing structure 2 only in the apex 5. Unlike for example a slot-shaped free space, the two-dimensional free space 7 prevents deposits of snow from clogging the free space 7.

FIG. 5 illustrates both a front jaw 20 of a ski binding, together with a rear jaw 24 of the ski binding.

LIST OF REFERENCE SIGNS

1 sole of the ski boot
1*a* upper side
1*b* front end
1*c* lower side of the sole
2 bearing structure
2*a* end
2*b* first region
2*c* second region
3 base
4 guide portion
5 apex
6 guide
7 free space
8 recess
10 ski boot
11 ski boot shell
20 front jaw
21 sole retainer
22 base structure
23 guide element
X direction, longitudinal direction
Y direction, vertical direction
X1 distance
X2 distance
Y1 distance
Y2 distance
24 rear jaw

The invention claimed is:

1. A combination of a downhill binding or downhill ski binding and a ski boot comprising:

(a) a ski boot which comprises a rigid ski boot shell and a sole of the ski boot comprising a front end of the sole, a rear end of the sole, an upper side of the sole and a lower side of the sole, and (b) a downhill binding which comprises a front jaw and a rear jaw, (c) wherein the downhill binding comprises a bearing structure for the sole of the ski boot, (d) the bearing structure having an apex, wherein the apex exhibits a perpendicular distance from the upper side of the sole of the ski boot held in the downhill binding of 19 mm±1 mm in at least one point, (e) wherein the apex has a distance, in the longitudinal direction, from the front end of the sole held in the downhill binding of at least 28 mm and at most 34 mm, (f) wherein an upper side of the bearing structure is not in contact with the lower side of the sole of the ski boot behind the apex in the skiing direction, and a free space is formed between the upper side of the bearing structure and the lower side of the sole, and (g) wherein the free space exhibits a distance (Y1) from a lower side of a planar sole of the ski boot according to DIN ISO 5355 of at least 5 mm at a distance (X2) behind the apex in the skiing direction of 20 mm±1 mm.

2. The combination according to claim 1, wherein the longitudinal distance is 32 mm±2 mm.

3. The combination according to claim 2, wherein the longitudinal distance is 32 mm±1 mm.

4. The combination according to claim 1, wherein a front attaching region of the ski boot comprises a bearing region in the lower side of the sole, via which the ski boot lies on the apex of the bearing structure.

5. The combination according to claim 4, wherein the bearing region comprises a two-dimensional recess, and the ski boot held in the downhill ski binding lies on the apex of the bearing structure in the region of the two-dimensional recess.

6. A front jaw of a downhill binding, wherein the downhill binding is a downhill binding according to claim 1.

7. The front jaw according to claim 6, wherein the apex is embodied centrically or in a region of the bearing structure which is a front region in the skiing direction, or the apex forms an end region of the bearing structure which is a rear end region in the skiing direction.

8. The front jaw according to claim 6, wherein the bearing structure comprises an arch which is formed from a first region having a first radius or a substantially straight line and a second region having a second radius or a substantially straight line.

9. The front jaw according to claim 8, wherein the second radius is larger than the first radius.

10. The front jaw according claim 8, wherein the arch is concave.

11. The front jaw according to claim 6, wherein the bearing structure is connected to the front jaw such that the bearing structure can move relative to the front jaw when the ski binding is released transversely.

12. The front jaw according to claim 6, wherein the binding also comprises a base structure, and a guide for a guide element formed by the base structure is formed or integrated in a base of the bearing structure.

13. The front jaw according to claim 12, wherein the guide is formed or integrated in the region of the bearing structure which is a rear region in skiing direction.

14. A bearing structure for connecting to a front jaw of a downhill binding, wherein the bearing structure is the bearing structure according to claim 1.

15. The bearing structure according to claim 14, wherein the bearing structure is a solid body, or a hollow body made of a metal or a plastic, or made of a metal and a plastic.

16. The bearing structure according to claim 15, wherein the bearing structure is a reinforced hollow body.

17. The bearing structure according to claim 14, wherein a surface of the bearing structure is at least embodied as a sliding surface for the sole of the ski boot in the region of the apex.

18. The combination according to claim 1, wherein the perpendicular distance is 19 mm±1 mm.

19. The combination according to claim 18, wherein the perpendicular distance is 19 mm±0.3 mm.

20. A bearing structure for connecting a front of a ski sole of a ski boot to a front jaw of a downhill binding, characterized in that the bearing structure has an apex which has a distance, in the longitudinal direction, from the front end of the sole held in the downhill binding to the apex of at least 28 mm and at most 34 mm, and wherein the apex exhibits a perpendicular distance from the upper side of the sole of the ski boot held in the downhill binding and at least one point of the apex of 19 mm±2 mm, wherein an upper side of the bearing structure is not in contact in skiing direction with the lower side of the sole of the ski boot behind the apex, and a preferably two-dimensional free space is formed between the upper side of the bearing structure and the lower side of the sole, and in that the free space exhibits a distance from a lower side of a planar sole of the ski boot to the upper side of the bearing structure according to DIN ISO 5355 of at least 5 mm at 20 mm±1 mm in the skiing direction behind the apex (5).

* * * * *